US009255715B2

(12) United States Patent
Hamel

(10) Patent No.: US 9,255,715 B2
(45) Date of Patent: Feb. 9, 2016

(54) NATURAL FUEL HEATING SYSTEM

(71) Applicant: James A. Hamel, New Britain, CT (US)

(72) Inventor: James A. Hamel, New Britain, CT (US)

( * ) Notice: Subject to any disclaimer, the term of this patent is extended or adjusted under 35 U.S.C. 154(b) by 294 days.

(21) Appl. No.: 13/945,867

(22) Filed: Jul. 18, 2013

(65) Prior Publication Data

US 2014/0026879 A1 Jan. 30, 2014

Related U.S. Application Data

(60) Provisional application No. 61/675,706, filed on Jul. 25, 2012.

(51) Int. Cl.

| | |
|---|---|
| ***F24B 7/04*** | (2006.01) |
| ***F24D 5/02*** | (2006.01) |
| ***F24B 7/02*** | (2006.01) |
| ***F24H 3/00*** | (2006.01) |
| ***F24H 9/00*** | (2006.01) |

(52) U.S. Cl.

CPC ... *F24D 5/02* (2013.01); *F24B 7/02* (2013.01); *F24B 7/04* (2013.01); *F24H 3/008* (2013.01); *F24H 9/0063* (2013.01); *F24D 2200/06* (2013.01)

(58) Field of Classification Search

CPC ..... F24D 5/02; F24B 7/02; F24B 7/04
USPC ..... 126/106, 112, 121, 67, 72; 110/297, 110/110

See application file for complete search history.

(56) References Cited

U.S. PATENT DOCUMENTS

| | | | | |
|---|---|---|---|---|
| 4,019,492 | A * | 4/1977 | Rush | 126/502 |
| 4,095,581 | A | 6/1978 | Billmeyer et al. | |
| 4,193,387 | A * | 3/1980 | Cline | 126/522 |
| 4,250,868 | A | 2/1981 | Frye | |
| 4,381,759 | A * | 5/1983 | Faustini | F24B 1/1886 126/152 B |
| 4,397,292 | A | 8/1983 | Mitchell | |
| 4,549,522 | A | 10/1985 | Savignac | |
| 4,584,987 | A * | 4/1986 | Rotili | F24B 1/183 126/514 |
| 4,611,572 | A | 9/1986 | Martenson | |
| 4,738,241 | A * | 4/1988 | Bernelov et al. | 126/522 |
| 4,844,051 | A | 7/1989 | Horkey | |
| 6,546,926 | B1 * | 4/2003 | Perrault | 126/77 |
| 2007/0289589 | A1 | 12/2007 | McFarland | |

FOREIGN PATENT DOCUMENTS

| | | | |
|---|---|---|---|
| DE | 40 12 363 | A1 | 10/1990 |

* cited by examiner

*Primary Examiner* — Gregory Huson
*Assistant Examiner* — Nikhil Mashruwala
(74) *Attorney, Agent, or Firm* — Richard C. Litman

(57) ABSTRACT

The natural fuel heating system includes an elongate firebox covered by a cowling. The firebox includes means for accessing the interior thereof for fuel placement and vents at opposite ends. The cowling surrounds a majority of the firebox and forms an air circulating barrier between the firebox and the cowling. Outside air is introduced into the barrier through an intake shroud extending from the back of the firebox. The natural fuel heating system includes a heat exchange system for efficiently heating the cooler outside air circulating within the barrier. The heated air is drawn through an exhaust shroud extending from the air barrier into a building ventilation system to heat the building via natural thermal convection and negative air pressure caused by oxygen consumption from combustion within the firebox. A waste gas exhaust vent protrudes from the firebox to deliver harmful exhaust gas back outside.

9 Claims, 5 Drawing Sheets

NATURAL FUEL HEATING SYSTEM

CROSS-REFERENCE TO RELATED APPLICATION

This application claims the benefit of U.S. Provisional Patent Application Ser. No. 61/675,706, filed Jul. 25, 2012.

BACKGROUND OF THE INVENTION

1. Field of the Invention

The present invention relates to heating systems, and particularly to a natural fuel heating system promoting healthier air circulation and improved heating inside a dwelling.

2. Description of the Related Art

Most buildings incorporate some sort of heating system, ranging from low tech options, such as a fireplace, to complex centralized air-conditioners. The efficiency of all these options varies greatly, depending on the inherent limitations of the system itself and the design of the building, including such factors as insulation and airflow.

One concern with all these systems is the economics of energy efficiency. In the case of a fireplace, the fuel required, e.g., wood, is relatively cheap. However, the heat from the fireplace is localized in the room where the fireplace is located, with no means of circulating the heated air within the building or dwelling that does not require some other external air circulating means, e.g., fans. Any heat generated by the fireplace extends into the room, but the typical stagnant air does not facilitate adequate airflow into other areas of the home. Thus, added equipment and the associated costs for operation and maintenance raises the overall costs, but provides minimal heating benefit to the rest of the building, especially if the building has poor insulation.

In many cases, the energy source for centralized heating and air conditioning systems is a combination of fossil fuel and electricity, the former for generating heat in a furnace and the latter for the fan system distributing the heat. Both forms of energy are relatively expensive, and many have to contend with sometimes astronomical costs during the winter months.

Another concern of common home heating systems relates to airflow. Most systems recirculate the interior air without introducing enough of the outside air to refresh the interior. As a result, much of the interior air is stagnant, which can become a health concern when the air is stagnant over extended periods of time. One way to mitigate this is to just open the house or building to outside air for short periods of time. In the long run, that only exacerbates energy consumption because it requires more energy to compensate for the large temperature difference than maintaining a relatively constant temperature.

Another problem that can occur is with fireplaces. Fireplaces require periodic maintenance and cleaning of the flue. Flues can become clogged with ashes and debris, which hampers airflow and leads to even more hazardous conditions, such as exposure to toxic fumes. Adequate airflow and a conscious effort to maintain such airflow can mitigate much of these concerns. However, many homeowners do not exercise such precautions.

In light of the above, it would be a benefit in the art of heating systems to provide a system that promotes adequate airflow and an economic alternative to current heating systems. Thus, a natural fuel heating system solving the aforementioned problems is desired.

SUMMARY OF THE INVENTION

The natural fuel heating system includes an elongate firebox covered by a cowling. The firebox includes means for accessing the interior thereof for fuel placement and vents at opposite ends. The cowling surrounds a majority of the firebox and forms an air circulating barrier between the firebox and the cowling. Outside air is introduced into the barrier through an intake shroud extending from the back of the firebox. The natural fuel heating system includes a heat exchange system for efficiently heating the cooler outside air that circulates within the barrier. The heated air is drawn through an exhaust shroud extending from the air barrier into a building ventilation system to heat the building via natural thermal convection and negative air pressure caused by oxygen consumption from combustion within the firebox. A waste gas exhaust vent protrudes from the firebox to deliver harmful exhaust gas back outside.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
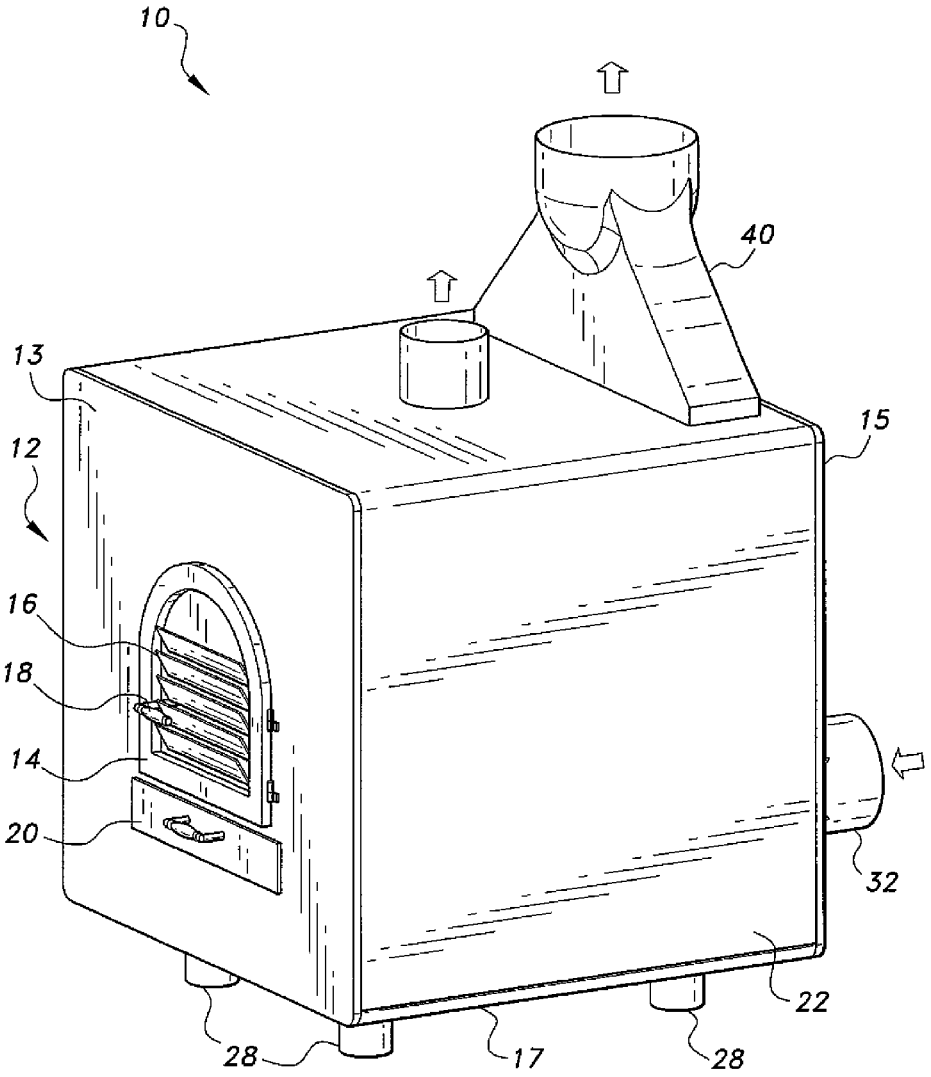
FIG. 1 is a perspective view of a natural fuel heating system according to the present invention.
Figure 2:
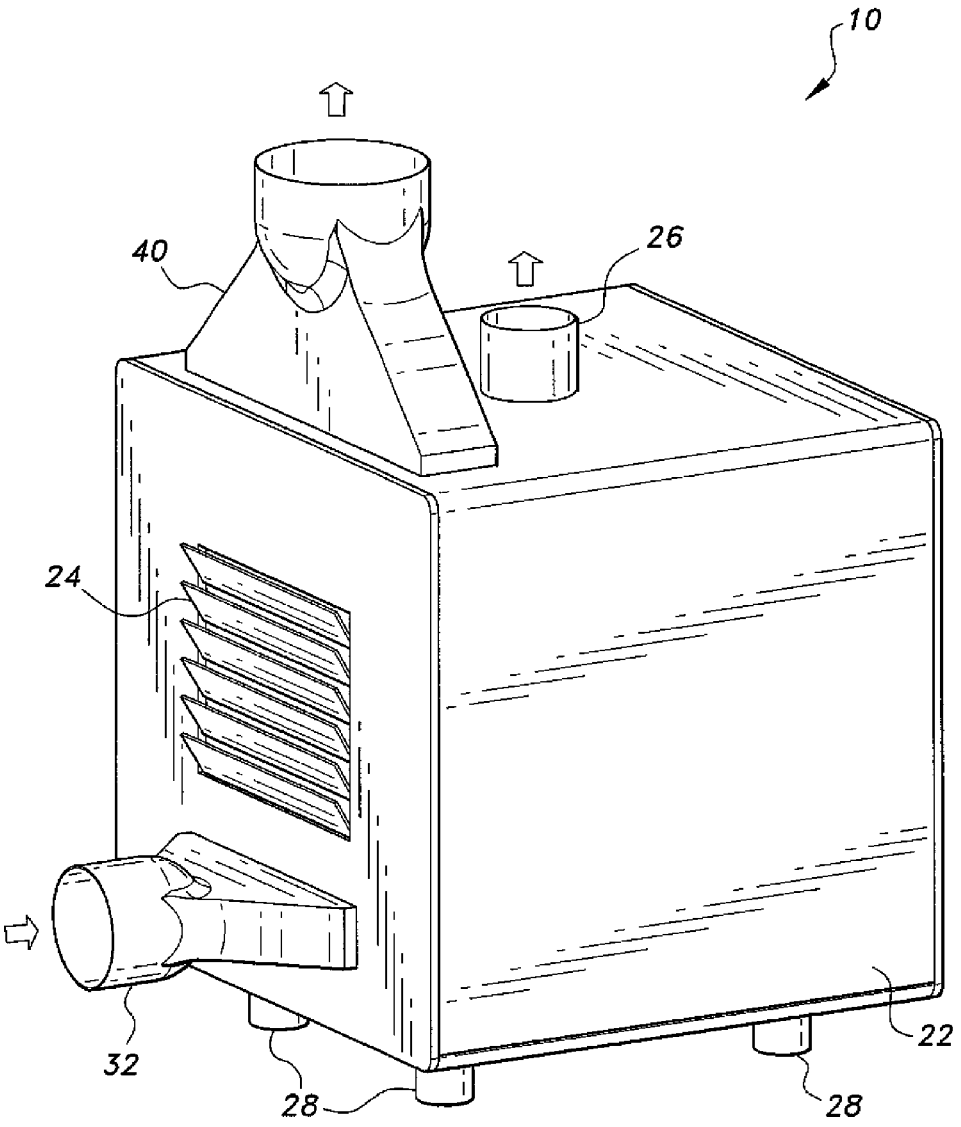
FIG. 2 is a perspective view of the natural fuel heating system of FIG. 1, shown from the rear.

The natural fuel heating system, generally referred to in the drawings by the reference number 10, provides a combination of enhanced airflow and the convenience of low cost fuel alternatives. As shown in FIGS. 1 and 2, the natural fuel heating system 10 includes a furnace housing or firebox 12 constructed in a similar manner to conventional wood stoves. The firebox 12 is preferably constructed as a hollow, metallic box structure having an interior combustion chamber. A pivotal gate, grate or cover 14 is provided at the front of the firebox 12 for accessing the interior in order to place wood or coal therein, as well as to perform periodic checks on combustion performance.

The pivotal grate 14 preferably includes a venting system in the form of a pivotal vane 16 disposed on the cover 14. Efficient combustion requires adequate airflow to supply oxygen. The vane 16 includes a handle 18 selectively operable by the user to vary the opening size and control the amount of ambient air, including oxygen, introduced into the combustion chamber. The firebox 12 can be provided with a slidable ash collector or drawer 20 for collecting all the byproducts from the burnt wood or coal and disposal thereof. As best shown in FIG. 2, the rear of the firebox 12 can include another vane 24 for increased ventilation.

Figure 3:
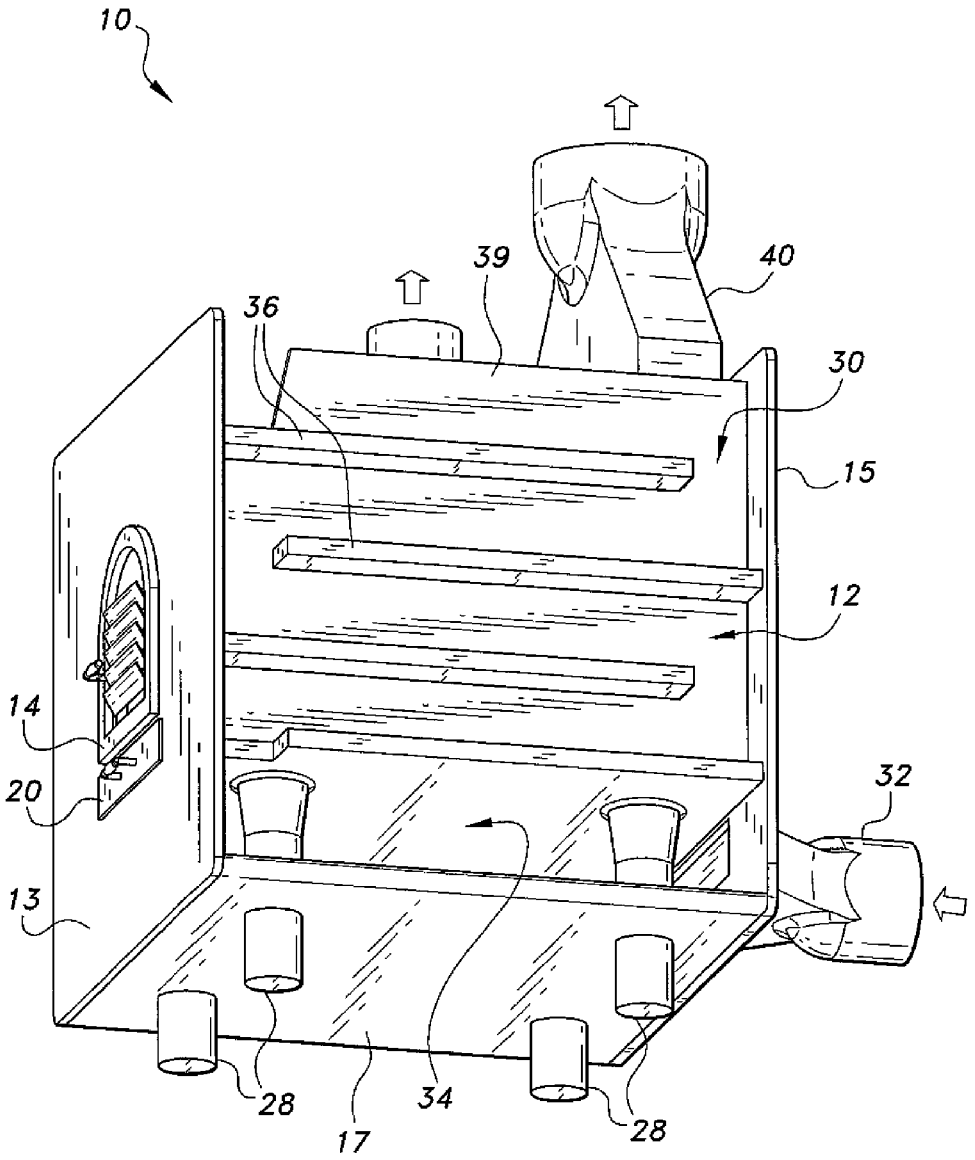
FIG. 3 is a bottom perspective view of the natural fuel heating system of FIG. 1, shown with the cowl removed.
Figure 4:
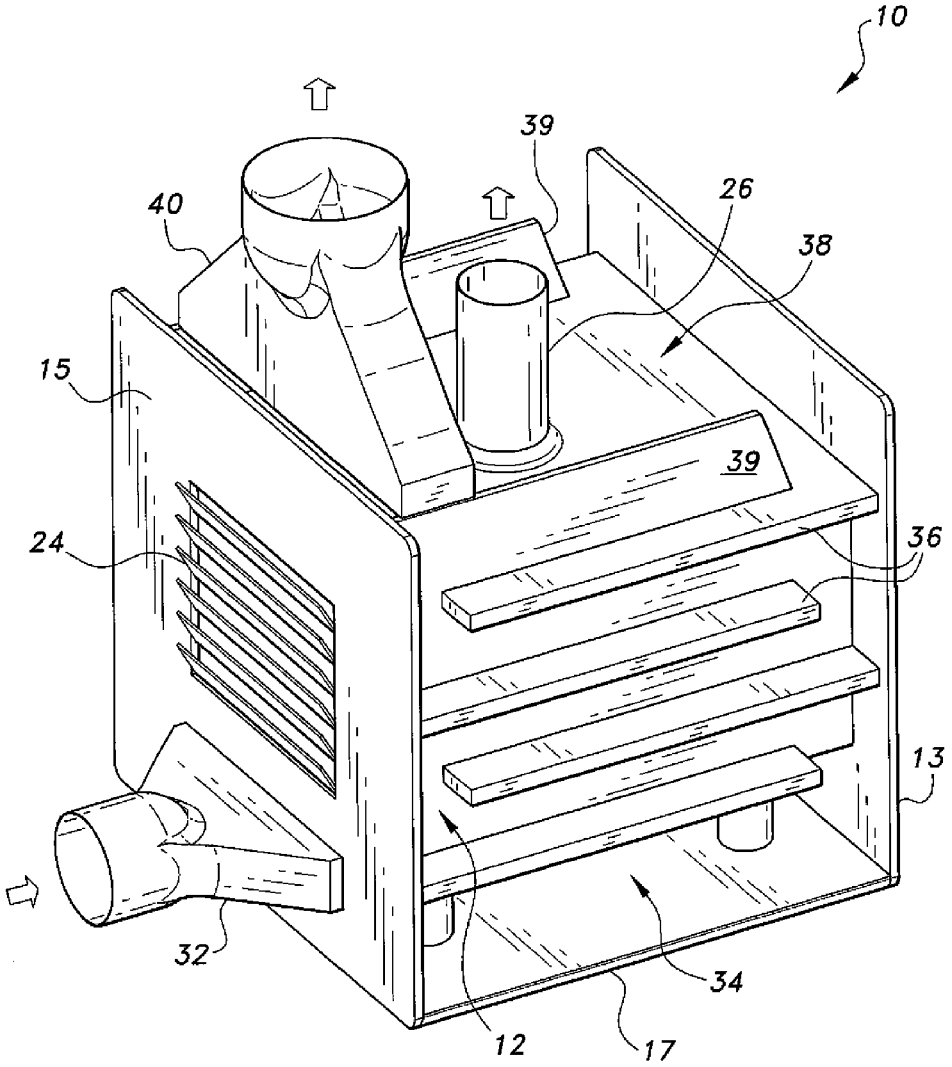
FIG. 4 is a perspective view of the natural fuel heating system of FIG. 1, shown with the cowl removed.

Unlike conventional wood furnaces or stoves, the natural fuel heating system 10 can include a removable cover or cowling 22, which conceals a heat exchange system 30 surrounding the firebox 12. It should be understood that the cowling 22 can also be permanently affixed around the firebox 12. The cowling 22 provides an air circulating space or channel between the cowling 22 and the central area of the firebox 12. As best shown in FIGS. 3 and 4, in which the cowling 22 has been removed, the heat exchange system 30 includes an intake shroud 32 disposed at the back of the firebox 12, the intake shroud 32 being in communication with the outside of the building and a first sub-chamber 34 at the bottom of the natural fuel heating system 10. The intake shroud 32 draws the colder outside air into the first sub-chamber 34 in order to circulate the air through the heat exchange system 30. Since hot air rises, the air circulates from natural convection caused by the temperature differential between the cold, outside air and the substantially higher heat from the firebox 12. In addition to thermal convection, part of the driving force for circulating the air is derived from negative air pressure. The process of combustion within the firebox 12 consumes oxygen, which is being supplied by the air around the natural fuel heating system 10. This causes a negative air pressure that helps circulate the air within the building. As the heated air rises through thermal convection from the heat exchange system 30, the negative air pressure helps to pull the heated air through vents inside the building to heat the same. The heated air will cool and subsequently flow back through household vents to the firebox 12, much like a closed-loop system.

The heat exchange system 30 includes a plurality of heat fins 36 extending from lateral sides of the firebox 12. These heat fins 36 are preferably arranged in an alternating pattern defining a serpentine path for the air to travel. The heat fins 36 provide increased surface area for distributing the heat from the firebox 12 to the flowing air, and the serpentine path increases the heat exposure for the air flowing therein.

As the air flows from the bottom, the first sub-chamber 34, and upward around the sides of the firebox 12 through the heat fins 36, the heated air flows towards the upper, second sub-chamber 38 and escapes through an exhaust shroud 40. The exhaust shroud 40 is constructed as a hollow, triangular structure resting or fixed atop a pair of spaced, upwardly extending support walls 39. These support walls 39 also function as additional heat fins, further maintaining the high temperature of the circulating air. The top of the exhaust shroud 40 is in communication with the interior building heating or air conditioning pipes. Thus, the exhaust shroud 40 funnels the heated air from the second sub-chamber 38 and exhausts the heated air throughout the building to heat the interior. Alternatively, the exhaust shroud 40 can be integrally attached to the cowling 22, providing a funneled channel for directing the heated air.

As can be seen from the drawings, the firebox 12 is generally an inner, elongate box-like structure capped at opposite, elongate ends by a front panel or wall 13 and a back panel or wall 15. The front and back panels 13, 15 are interconnected at the bottom by an elongate bottom panel 17. As mentioned previously, the cowling 22 surrounds the firebox 12 in order to create an inner airflow chamber or barrier around the firebox 12. For construction purposes, the cowling 22 can be mounted to the firebox 12 with welds and/or fittings on the seams to seal the same in order to minimize escaping or leaking air for maximum heating performance. Along the same lines, the firebox 12 also includes a waste exhaust vent, pipe or chute 26 extending upwardly from the upper surface of the firebox 12. The exhaust vent 26 draws the harmful gases from the combustion chamber towards the outside of the building through appropriate pipes. This construction separates the air and airflow between the air required to facilitate combustion within the firebox 12, i.e., oxygen, and the air being heated for circulation throughout the building. Moreover, this construction insures safe operation within the building or dwelling because exposure to the potentially harmful effects of combustion gases is kept to a minimum. For even better performance, periodic cleaning of the exhaust vent 26 and the associated pipes should be maintained in much the same manner as a flue and chimney in a fireplace.

Both the exhaust shroud 40 and the exhaust vent 26 protrude through the top of the cowling 26. To prevent leakage, the holes in the cowling 26 for the shroud 40 and the vent 26 can be sealed with fittings.

Due to the relatively high operating temperatures and concerns for fire safety, it is preferable that the natural fuel heating system 10 be placed at an elevated position. Thus, the natural fuel heating system 10 includes a plurality of support legs 28 extending downward from the bottom of the firebox 12 through the bottom panel 17. The support legs 28 place the firebox 12 above the floor of the building, providing a natural air insulating barrier between the bottom of the natural heating system 10 and the floor. Preferably, the natural fuel heating system 10 should also be installed in a relatively fireproof environment or fire-blocked area. Although the support legs 28 are shown to be extending from the bottom of the firebox 12, the legs 28 can alternatively extend from the bottom panel 17.

Figure 5:
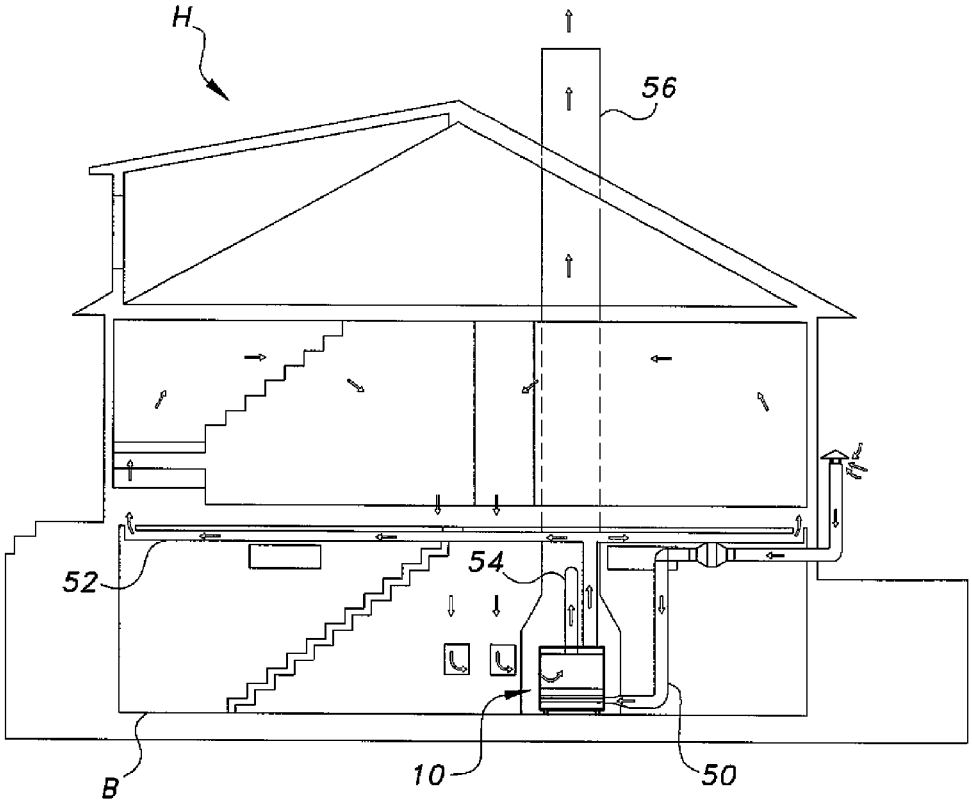
FIG. 5 is an environmental side view of a dwelling having the natural fuel heating system of FIG. 1, schematically illustrating airflow paths through the building.

As best shown in FIG. 5, the drawing shows the natural fuel heating system 10 in operation inside a home dwelling H. Like most conventional homes, the natural fuel heating system 10 is installed down in the basement B, where the foundation provides an excellent fire-block and takes advantage of the natural rising and falling movement of heated air. The natural fuel heating system 10 draws outside fresh air through the inlet pipe 50 and the intake shroud 32. As the cooler air heats from the firebox 12, the heated air circulates around the heat exchange system 30 and rises to be funneled through the exhaust shroud 40. The exhaust shroud 40 is in communication with the interior home ventilation pipes 52, which distribute the heated air through vents into various rooms of the home H. The negative air pressure caused by oxygen consumption during combustion helps pull the heated air through ventilation pipes 52. As the thermal energy of the heated air dissipates, the cooled air drops and recirculates back into the natural fuel heating system 10, providing the necessary oxygen for combustion. The product gases from the firebox 12 rise through the waste gas exhaust vent 26 and are ventilated back outside via the exhaust vent 26, which is in communication with an outlet pipe 54. The outlet pipe 54 directs air into a chimney-like structure 56 permitting the exhaust gases to escape into the outside environment. Although not shown, the inlet side and/or the outlet side of the natural fuel heating system 10 can include fans or similar mechanisms for more positive means of moving air. For maximum performance, the home H should be well insulated and sealed to prevent unwanted drafts. A drafty dwelling can significantly decrease heating performance of the natural fuel heating system 10 as well as more conventional heating systems. The drafty dwelling increases energy consumption due to the increased time and fuel needed to raise a dwelling temperature to the desired temperature compared to a non-drafty dwelling. In order to maintain that desired temperature, the heating system also requires even more energy expenditure and fuel.

Thus, it can be seen that the natural fuel heating system 10 provides economic heating benefits of a fireplace or woodstove without much of the inefficiency and potential health hazard. The fuel for heating is relatively cheap compared to gas or electric. Instead of recirculating interior air for combustion and heating, the natural fuel heating system 10, in operation, continuously circulates fresh outside air for heating purposes, which avoids air stagnation and the associated potential harm. The exhaust gases are separated from the air used for heating, which also reduces risks from exposure to toxic fumes or gases.

It is to be understood that the present invention is not limited to the embodiments described above, but encompasses any and all embodiments within the scope of the following claims.

I claim:

1. A natural fuel heating system, comprising:

an elongate firebox having a front panel, a back panel, a bottom panel, and a combustion chamber disposed between the front and back panels, the combustion chamber being configured for receiving natural fuel and combustion of the natural fuel therein, the combustion chamber having a top, a bottom and lateral sides, wherein at least one of the front or back panel includes a vane for increased ventilation;

a heat exchange system surrounding the combustion chamber, the heat exchange system heating and circulating outside air to be delivered throughout a building, wherein said heat exchange system comprises:

i) a first sub-chamber formed between the combustion chamber and the bottom panel, the bottom panel being spaced from the bottom of the combustion chamber;

ii) an intake shroud attached to the back panel, the intake shroud introducing the outside air into the first sub-chamber to thereby expose the outside air to heat from the combustion chamber and circulate the outside air around the combustion chamber through thermal convection;

iii) a plurality of heat fins disposed on and extending outwardly from the lateral sides of the combustion chamber, the heat fins simultaneously heating the outside air and forming a circulation path for the outside air, each of the plurality of heat fins comprises an elongate member, wherein the plurality of heat fins being arranged in a staggered pattern on each lateral side of said combustion chamber, the pattern forming a serpentine path for the outside air to maximize heat exposure and heat exchange;

iv) a second sub-chamber formed at the top of said combustion chamber; and v) at least a pair of spaced support walls projecting from the top of said combustion chamber, the support walls supporting said exhaust shroud, thereby exhausting the heated outside air through said exhaust shroud to be circulated by the ventilation system;

a cowling attached to the firebox, the cowling substantially surrounding the firebox to form an air circulating barrier between the combustion chamber and the cowling;

an exhaust shroud attached to the firebox, the exhaust shroud being adapted for connection to a building ventilation system in order to deliver heated air thereto; and an exhaust vent connected to the firebox for removing exhaust gases from the combustion chamber.

2. The natural fuel heating system according to claim 1, wherein said combustion chamber comprises walls having smaller dimensions than said front panel, said back panel, and said bottom panel.

3. The natural fuel heating system according to claim 1, wherein said exhaust shroud comprises a hollow, substantially triangular structure funneling heated outside air to the ventilation system, the triangular structure having an open base at one end resting atop said support walls, the triangular structure extending through said cowling and having an opposite outlet end at the apex thereof for connecting the exhaust shroud to the ventilation system.

4. The natural fuel heating system according to claim 1, wherein said exhaust vent comprises an elongate pipe extending from said combustion chamber and through said cowling.

5. The natural fuel heating system according to claim 1, further comprising a plurality of feet extending from the bottom of said combustion chamber, said feet elevating said firebox off the floor of the building in order to provide a natural air insulating bather between the floor and said natural fuel heating system.

6. The natural fuel heating system according to claim 1, further comprising a gate pivotally mounted to said front panel, selective opening and closing of the gate facilitating access to the interior of said combustion chamber for feeding natural fuel therein, the gate having a venting system disposed thereon.

7. The natural fuel heating system according to claim 6, wherein said venting system comprises at least one pivotal vane selectively operable by a user to vary opening size and control the amount of ambient air and oxygen introduced into said combustion chamber.

8. The natural fuel heating system according to claim 1, further comprising an ash collector slidably mounted to said front panel and extending into said combustion chamber, the ash collector collecting combusted byproducts from burnt natural fuel for subsequent disposal.

9. A method of efficiently heating a building using natural fuels, comprising the steps of:

providing a natural fuel heating system, the natural fuel heating system comprising:

an elongate firebox having a front panel, a back panel, a bottom panel, and a combustion chamber disposed between the front and back panels, the combustion chamber being configured for receiving natural fuel and combustion of the natural fuel therein, the combustion chamber having a top, a bottom and lateral sides;

a heat exchange system surrounding the combustion chamber, the heat exchange system heating and circulating outside air to be delivered throughout a building, wherein the heat exchange system comprises:

i) a first sub-chamber formed between the combustion chamber and the bottom panel, the bottom panel being spaced from the bottom of the combustion chamber;

ii) an intake shroud attached to the back panel, the intake shroud introducing the outside air into the first sub-chamber to thereby expose the outside air to heat from the combustion chamber and circulate the outside air around the combustion chamber through thermal convection;

iii) a plurality of heat fins disposed on and extending outwardly from the lateral sides of the combustion chamber, the heat fins simultaneously heating the outside air and forming a circulation path for the outside air, each of the plurality of heat fins comprises an elongate member, wherein the plurality of heat fins being arranged in a staggered pattern on each lateral side of said combustion chamber, the pattern forming a serpentine path for the outside air to maximize heat exposure and heat exchange;

iv) a second sub-chamber formed at the top of said combustion chamber; and v) at least a pair of spaced support walls projecting from the top of said combustion chamber, the support walls supporting said exhaust shroud, thereby exhausting the heated outside air through said exhaust shroud to be circulated by the ventilation system;

a cowling attached to the firebox, the cowling substantially surrounding the firebox to form an air circulating barrier between the combustion chamber and the cowling;

an exhaust shroud attached to the firebox, the exhaust shroud being adapted for connection to a building ventilation system in order to deliver heated air thereto; and an exhaust vent connected to the firebox for removing exhaust gases from the combustion chamber;

connecting the exhaust shroud to the building ventilation system;

connecting the exhaust vent to a vent pipe extending outside the building to exhaust harmful gases;

feeding natural fuel into the combustion chamber;

burning the natural fuel to generate heat;

permitting outside air to flow through the heat exchange system to heat the outside air; and circulating the heated air into the building through the ventilation system.

* * * * *